US008640280B2

(12) United States Patent
Gutierrez et al.

(10) Patent No.: US 8,640,280 B2
(45) Date of Patent: Feb. 4, 2014

(54) CRIB WITH ADJUSTABLE HEIGHT MATTRESS

(75) Inventors: Roberto Gutierrez, El Paso, TX (US); Anna L. Jacques, Broussard, LA (US)

(73) Assignee: Inicia IP Holdings, LLC, Albuquerque, NM (US)

( * ) Notice: Subject to any disclaimer, the term of this patent is extended or adjusted under 35 U.S.C. 154(b) by 75 days.

(21) Appl. No.: 13/417,778

(22) Filed: Mar. 12, 2012

(65) Prior Publication Data

US 2012/0297537 A1 Nov. 29, 2012

Related U.S. Application Data

(60) Provisional application No. 61/488,870, filed on May 23, 2011.

(51) Int. Cl.
*A47D 13/06* (2006.01)

(52) U.S. Cl.
USPC ..... 5/93.1; 5/611; 5/100; 5/97

(58) Field of Classification Search
USPC ..... 5/93.1, 100, 109, 97, 11; 404/788, 340
See application file for complete search history.

(56) References Cited

U.S. PATENT DOCUMENTS

| | | | | |
|---|---|---|---|---|
| 7,827,631 | B2 * | 11/2010 | Holman | 5/93.1 |
| 2002/0157180 | A1 * | 10/2002 | Koenig et al. | 5/93.1 |
| 2004/0244109 | A1 * | 12/2004 | Koenig et al. | 5/93.1 |
| 2005/0246835 | A1 * | 11/2005 | Tu | 5/93.1 |
| 2009/0070929 | A1 * | 3/2009 | Holman | 5/93.1 |
| 2010/0162482 | A1 * | 7/2010 | Cohen et al. | 5/11 |
| 2011/0203049 | A1 * | 8/2011 | Carta | 5/93.1 |
| 2012/0167299 | A1 * | 7/2012 | Tarquinio | 5/93.1 |

* cited by examiner

*Primary Examiner* — Peter M Cuomo
*Assistant Examiner* — Brittany Wilson
(74) *Attorney, Agent, or Firm* — Kermit D. Lopez; Luis M. Ortiz; Ortiz & Lopez, PLLC

(57) ABSTRACT

A apparatus with an adjustable height mattress can include a crib frame with a stationary support frame secured to it. The mattress rests generally on an elevator frame which slides up and down with respect to the stationary frame. The crib further includes a height adjusting mechanism for adjusting height of the elevator frame, an operating mechanism for operating and locking the height adjusting mechanism and a leveling mechanism for maintaining the level of elevator frame horizontally stable. The mattress height can be adjusted not only on a semi-permanent basis, but can also be varied as needed. The mattress can be set high when a parent is placing a child in the crib and can be lowered with the child on it for the child's safety. The elevator frame may also be manually raised with the child on it via an external handle.

20 Claims, 7 Drawing Sheets

CRIB WITH ADJUSTABLE HEIGHT MATTRESS

CROSS-REFERENCE TO PROVISIONAL APPLICATION

This patent application claims the benefit under 35 U.S.C. §119(e) of U.S. Provisional Application Ser. No. 61/488,870 entitled, "Crib With Adjustable Height Mattress," which was filed on May 23, 2011 and is incorporated herein by reference in its entirety.

TECHNICAL FIELD

Embodiments are generally related to a baby crib. Embodiments also relate to a crib with adjustable height mattress. Embodiments additionally relate to a baby crib with a mattress that can be adjusted not only on a semi-permanent basis, but can also be adjusted real-time as needed.

BACKGROUND OF THE INVENTION

One major difficulty with baby cribs is that as the child grows in height and physical abilities, it is necessary to set the mattress lower and lower with respect to the top of the crib gate. This is done for the child's safety, to keep him from crawling over the gate and out of the crib. Most cribs can be adjusted to account for this. This is typically done in a "set it and leave it" manner, meaning that the adjustment is a relatively involved procedure and the mattress is meant to be adjusted (lowered) once and then left in its new height setting.

Aside from the fact that the mattress adjustment is cumbersome and difficult to make, the main difficulty arises from the fact that, as the mattress is required to be set lower and lower, the child himself is getting taller (and heavier). Since the mattress is set at a low height permanently (for all intents and purposes), as the weight of the child increases, the parent carrying the child must bend down to lay the child on the mattress. The strain on the parent's lower back caused by lowering a heavy sleeping child over a crib gate and down onto a low-set mattress can be incredibly taxing, even on a healthy adult. If that adult happens to be among the millions with back problems or other debilitating diseases, the daily challenges can be almost insurmountable.

Previous attempts at addressing this problem were made with the introduction of the lowering gate. Such crib has a front gate designed as a two-piece assembly which allows the top half to be slid or swung down. This design has been banned in the United States due to incidents of unintended and sudden gate lowering, which resulted in injuries to children. Therefore there exists a need for a crib with a mattress that can be adjusted easily and quickly without causing any injuries to children and parents.

BRIEF SUMMARY

The following summary is provided to facilitate an understanding of some of the innovative features unique to the disclosed embodiment and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for a baby crib.

It is another aspect of the disclosed embodiments to provide for a baby crib with adjustable height mattress.

It is another aspect of the disclosed embodiments to provide for a baby crib with a mattress that can be adjusted not only on a semi-permanent basis, but can also be adjusted real-time as needed.

The aforementioned aspects and other objectives and advantages can now be achieved as described herein. A crib with adjustable height mattress has a crib frame with a stationary support frame secured to it. The mattress rests on an elevator frame which slides up and down with respect to the stationary frame. The crib further comprises a height adjusting component or mechanism for adjusting the height of the elevator frame, an operating component or mechanism for operating and locking the height adjusting mechanism and a leveling mechanism or component for maintaining the level of elevator frame horizontally stable.

The mattress height can be adjusted not only on a semi-permanent basis, but can also be adjusted real-time as needed. The mattress can be set high when a parent is placing a child in the crib and can be lowered with the child on it for the child's safety. The elevator frame may also be manually raised with the child on it via an external handle. The elevator frame may be kept level by a number of components and mechanism, such as, for example, guide bars, rails, captured pin and slot configurations, etc. A parent can raise the mattress with little or no effort to easily retrieve a child who is either still asleep or otherwise indisposed. Most importantly, the crib is designed in such a way that even if a failure occurs, it will not result in a dangerous situation for the child or the parent.

A number of embodiments, preferred and alternative, are disclosed herein. In one embodiment, a baby crib adjustment apparatus can be provided, which includes a crib frame for securing a fixed frame and an elevator frame, and a mattress capable of resting on the elevator frame. Additionally, a height adjusting mechanism can be provided for adjusting height of the elevator frame, in association with an operating mechanism for operating and locking the height adjusting mechanism, and a leveling mechanism for maintaining the level of the elevator frame horizontally stable.

In another embodiment, the lifting mechanism can be attached to the elevator frame for manually rising the elevator frame from outside when a child is on the mattress. In some embodiments, the mattress can be raised by exerting force on the operating mechanism and then locked at highest position by releasing the operating mechanism. Additionally, the mattress with a child can be easily raised by exerting forces on the operating mechanism and the lifting mechanism and then locked at highest position by releasing the operating mechanism. The mattress can also be lowered by exerting force on the operating mechanism and locked at lowest position by releasing the operating mechanism. In other embodiments, the height adjusting mechanism can adjust the height of the mattress by operating the operating mechanism and the lifting mechanism.

In still other embodiments, a baby crib adjustment apparatus can be configured which includes a fixed frame and an elevator frame, and a mattress resting on the elevator frame. The apparatus can include a height adjusting mechanism for adjusting height of the elevator frame, an operating mechanism for operating and locking the height adjusting mechanism, and a leveling mechanism for maintaining the level of the elevator frame horizontally stable. In other embodiments, the crib frame can be provided for securing the fixed frame and the elevator frame. In still other embodiments, a lifting mechanism can be attached to the elevator frame for manually rising the elevator frame from outside when a child is on the mattress.

The mattress can be raised by exerting force on the operating mechanism and then locked at highest position by releasing the operating mechanism. The mattress with the child can be effortlessly raised by exerting forces on the operating mechanism and the lifting mechanism and then locked at highest position by releasing the operating mechanism. The mattress can be lowered by exerting force on the operating mechanism and locked at lowest position by releasing the operating mechanism. The height adjusting mechanism can also adjust the height of the mattress by operating the operating mechanism and the lifting mechanism.

It should be noted that other alternative methods or devices or apparatus can be utilized for achieving the disclosed concept. For example a double set of scissors with a locking gas strut can be replaced by other arrangements utilizing, for example, a gas strut, hydraulic piston, or similar mechanism or component that can supply the force required to elevate or lower the mattress on demand.

BRIEF DESCRIPTION OF THE DRAWINGS

The accompanying figures, in which like reference numerals refer to identical or functionally-similar elements throughout the separate views and which are incorporated in and form a part of the specification, further illustrate the disclosed embodiments and, together with the detailed description of the invention, serve to explain the principles of the disclosed embodiments.

FIG. 6(*b*) illustrates a perspective view of the leveling mechanism of FIG. 6(*b*) including the aforementioned double scissor arrangement with a pin/slot arrangement, in accordance with the disclosed embodiments.

DETAILED DESCRIPTION

The particular values and configurations discussed in these non-limiting examples can be varied and are cited merely to illustrate at least one embodiment and are not intended to limit the scope thereof.

The embodiments now will be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art.

Figure 1:
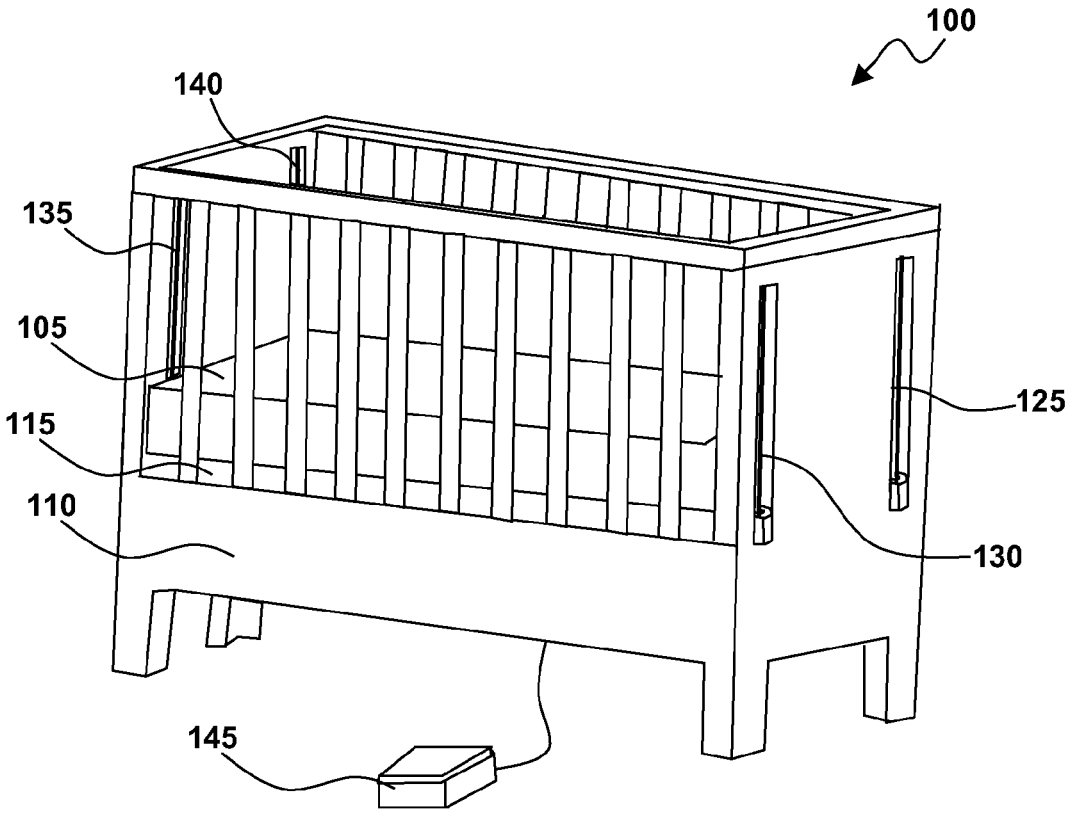
FIG. 1 illustrates a perspective view of a crib with adjustable height mattress in lowest position, in accordance with the disclosed embodiments.

FIG. 1 illustrates a perspective view of a crib 100 with adjustable height mattress 105 in lowest position, in accordance with the disclosed embodiments. The crib 100 has a crib frame 110 with a stationary support frame (not shown) secured to it. The mattress 105 rests on an elevator frame 115 which slides up and down guided by four vertical bars 125, 130, 135 and 140 attached to the crib frame 110 (one at each corner). A pedal 145 at the foot of the crib 100 can be utilized to adjust the height of the mattress 105.

Figure 2:
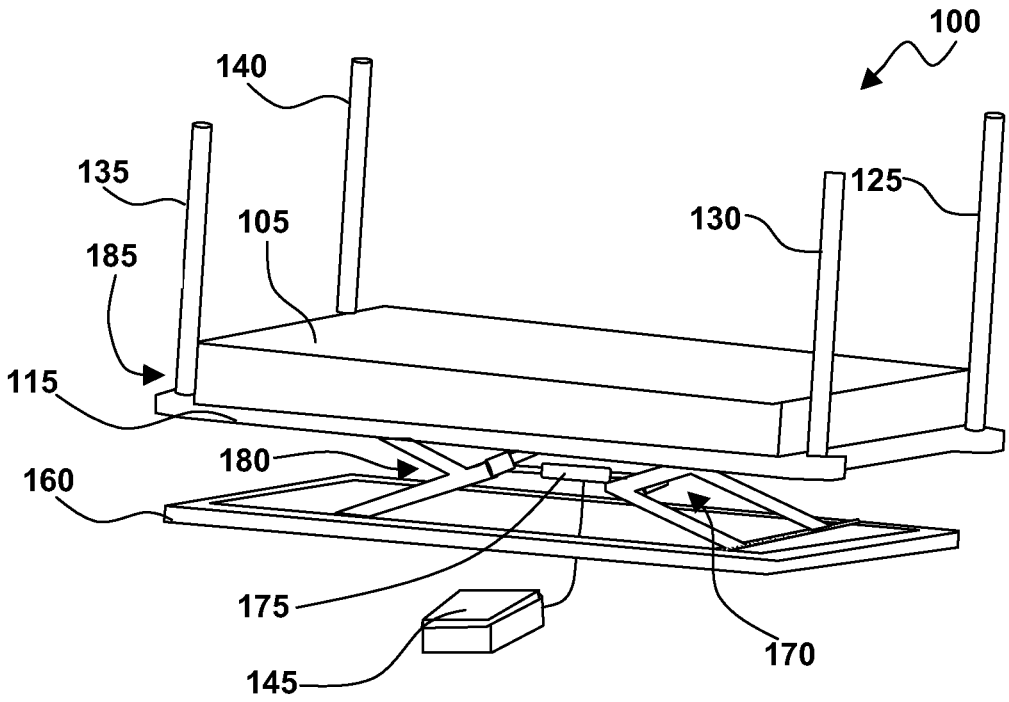
FIG. 2 illustrates a perspective view of the crib of FIG. 1 with the crib frame hidden from view for clarity, in accordance with the disclosed embodiments.

FIG. 2 illustrates a perspective view of the crib of FIG. 1 with the crib frame 110 hidden from view for clarity, in accordance with the disclosed embodiments. The elevator frame 115 and the stationary frame 160 are connected by two sets of double scissors 170 and 180 arranged in such a way as to accept a locking gas strut 175 in between. The locking strut 175 may be released via the pedal 145. The locking gas strut 175 is sized such as to exert an upward force just slightly higher than what is required to lift an unoccupied mattress 105 or elevator frame assembly 185.

Figure 3:
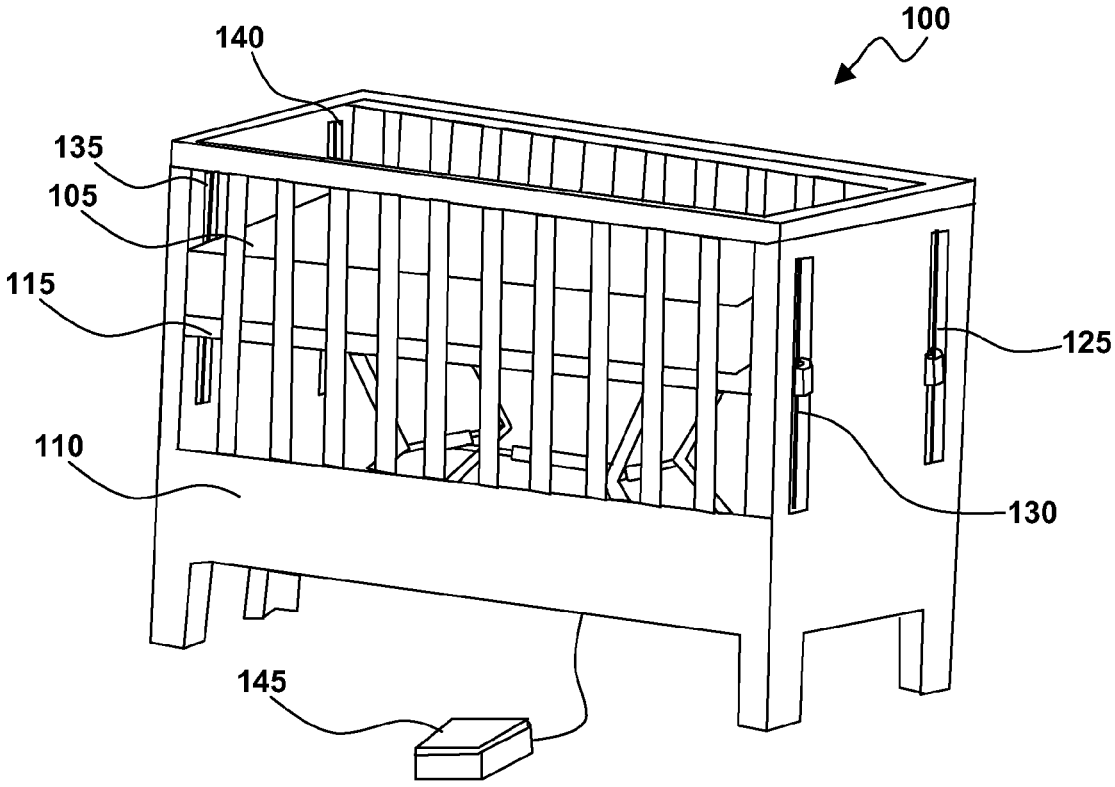
FIG. 3 illustrates a perspective view of the crib of FIG. 1 showing the adjustable height mattress in highest position, in accordance with the disclosed embodiments.

FIG. 3 illustrate a perspective view of the crib of FIG. 1 showing the adjustable height mattress in highest position, in accordance with the disclosed embodiments. Starting from an unoccupied mattress 105 in the lowest position as shown in FIG. 1 and FIG. 2, pressing the pedal 145 causes the locking gas strut 175 to release and exert enough force to raise the mattress 105 or elevator frame assembly 185 to the highest position. The pedal 145 may be released at this time, locking the gas strut 175 in its fully extended position.

Figure 4:
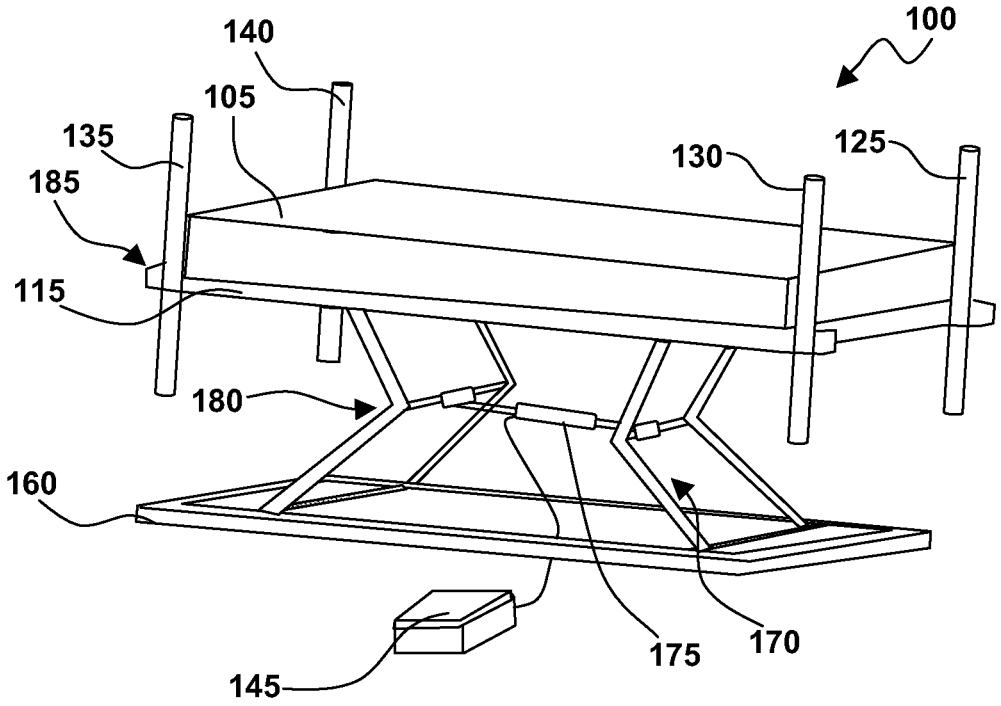
FIG. 4 illustrates a perspective view of the crib of FIG. 3 with the crib frame hidden from view for clarity, in accordance with the disclosed embodiments.

FIG. 4 illustrates a perspective view of the crib of FIG. 3 with the crib frame 110 hidden from view for clarity, in accordance with the disclosed embodiments. With the mattress 105 at the highest position, a sleeping child may be laid down without difficulty. At this time the pedal 145 may be pressed again, once again unlocking the gas strut 175. Since the force of the unlocked gas strut 175 is only enough to offset the weight of an unoccupied mattress 105, the added weight of the child causes the mattress 105 or elevator frame assembly 185 to lower as long as the pedal 145 is kept depressed. Due to the dampening action of the gas strut 175, this lowering motion is smooth and controlled, unlikely to disturb the still sleeping child. Once in the lowest position the pedal 145 is released again, locking the gas strut 175 in its fully compressed position. This keeps the mattress 105 at its lowest position.

Figure 5:
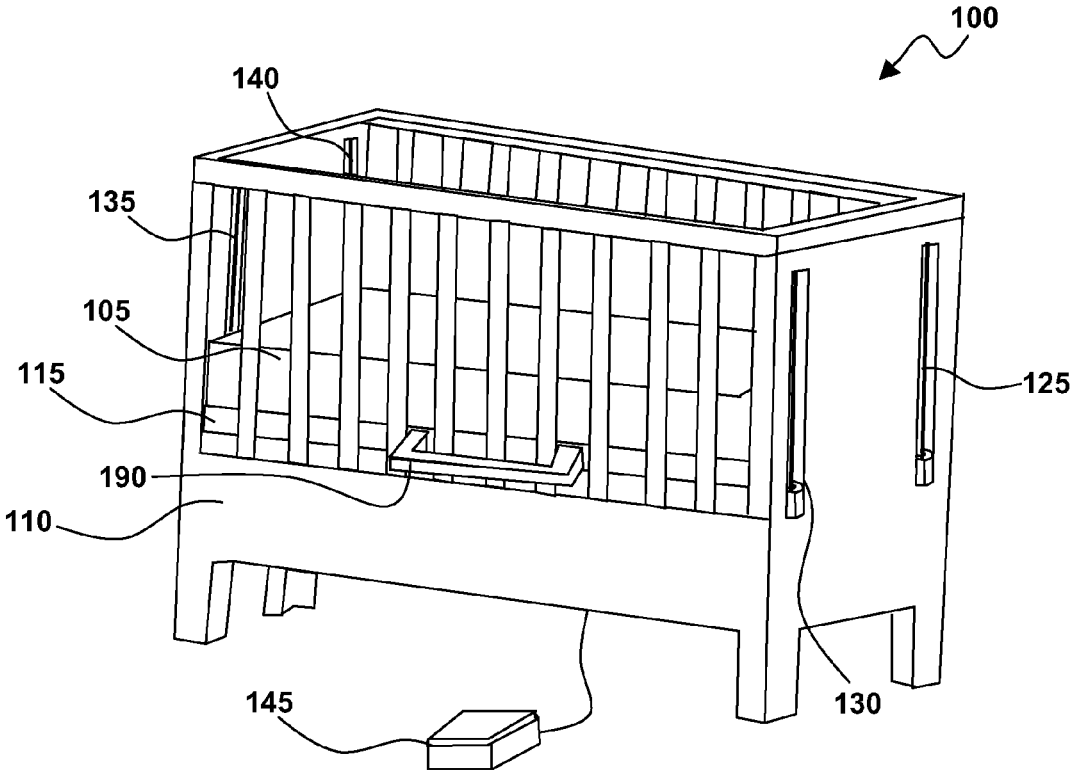
FIG. 5 illustrates a perspective view of the crib of FIG. 1 with handle, in accordance with the disclosed embodiments.

The elevator frame 115 can be manually raised via a handle, lever, etc., which may be operated from outside the crib 100. FIG. 5 illustrates a perspective view of the crib 100 of FIG. 1 with handle 190, in accordance with the preferred embodiments. In this embodiment, the crib 100 with handle 190 would size the locking gas strut 175 to exert approximately 10 Lbs over the force required to lift the mattress 105 or elevator frame 115. This force would take into account the weight of the elevator frame 115, mattress 105 including bedding, other hardware including the double scissors 170 and 180, fasteners, bushings, etc., and the effects of friction at the guiding bars 125, 130, 140 and 145 and double scissors 170 and 180. For example, a 25 Lb child would only exert a net downward force of 15 Lbs when placed on the mattress. This would facilitate the process of raising the elevator frame to its highest position even with the child on it, further facilitating taking the child out of the crib.

The disclosed embodiments as in FIG. 1-5 uses double scissors 170 and 180 with locking gas strut 175 as a height adjusting mechanism or component, a pedal 145 as an operating mechanism or component and four guiding bars 125, 130, 135 and 140 as a leveling mechanism or component.

Figure 6B:
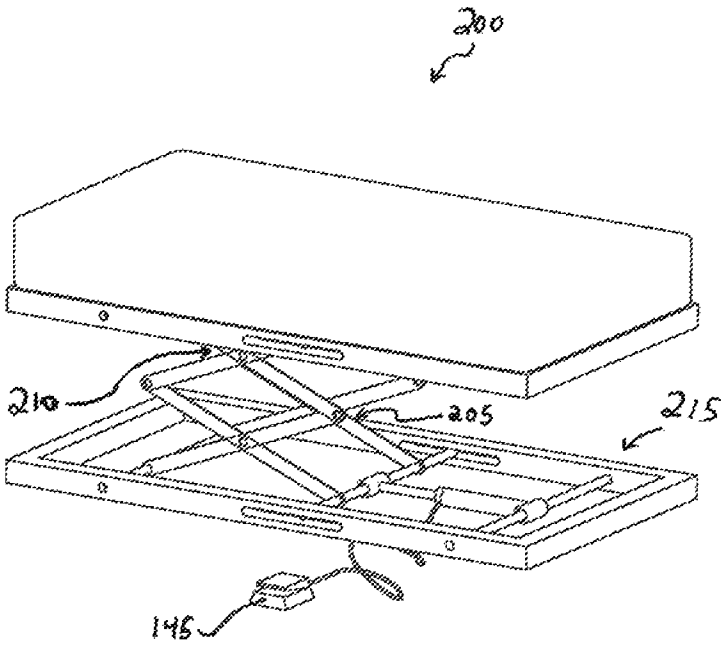
FIG. 6(*a*) illustrates a side view of a leveling mechanism that includes a double scissor arrangement with a pin/slot arrangement, in accordance with the disclosed embodiments.
Figure 6A:
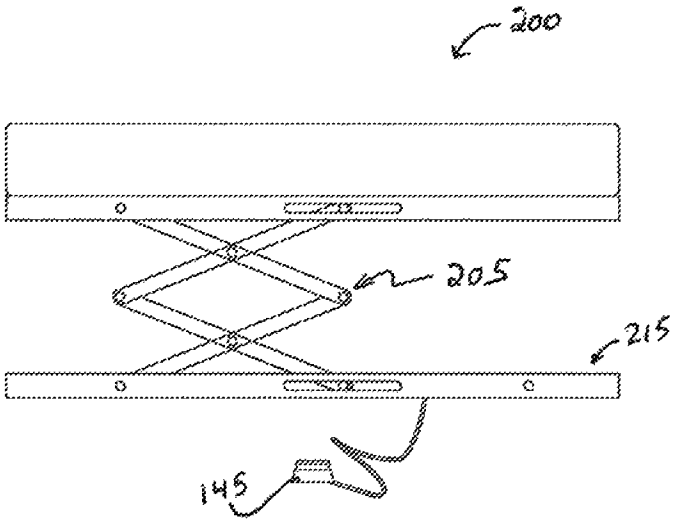

FIGS. 6(*a*)-6(*b*) illustrate an apparatus 200 comprising a pair of double scissors 205 and 210 with a captured-pin/slot arrangement 215 utilized as a leveling mechanism or component. There are many ways to keep the adjustable elevator frame horizontally stable. Some of its examples are use of guiding bars and double scissors with a captured-pin/slot arrangement as shown in FIGS. 1-5 and FIG. 6 respectively.

Figure 7:
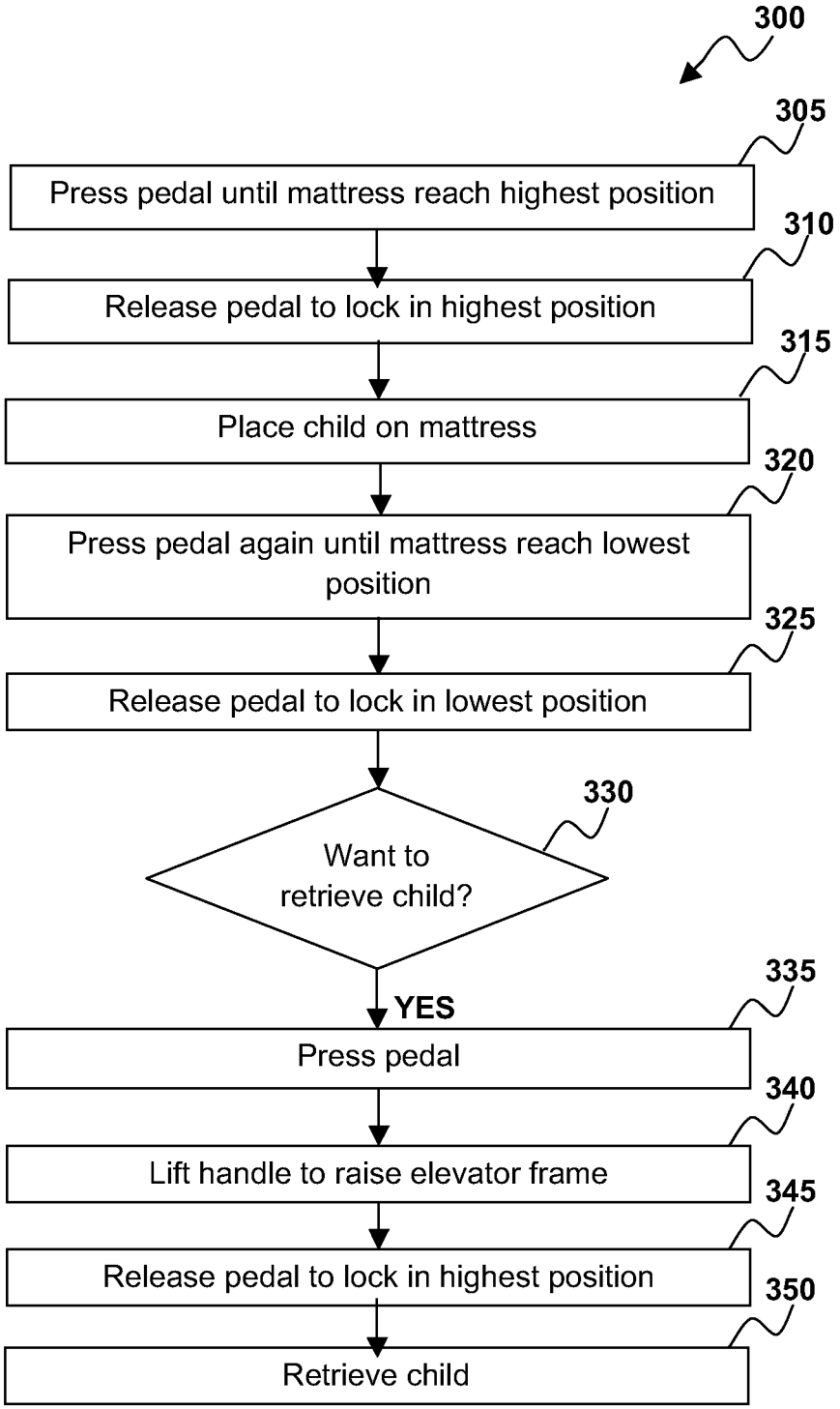
FIG. 7 illustrates a flowchart depicting a process of utilizing the baby crib of FIG. 1 for sleeping, in accordance with the disclosed embodiments.

FIG. 7 illustrates a flow chart 300 depicting the process of utilizing the baby crib of FIG. 1 for sleeping, in accordance with the disclosed embodiments. As illustrated at block 305, the pedal at the bottom of the crib can be pressed until the mattress or the elevator frame in the lower position attains the highest position. Once the highest position has been reached, releasing the pedal will lock the gas strut in fully extended position as illustrated at block 310. Then as depicted at block 315 the sleeping child is placed on the mattress. The pedal is pressed again to release the gas strut and allow the elevator frame to lower under the weight of the child as indicated at block 320.

Releasing the pedal once again at this position will lock the gas strut in fully compressed position as depicted at block 325. This keeps the mattress at its lowest position. As depicted at block 330 when the parent wants to retrieve the child from the mattress, while pressing the pedal to unlock the gas strut, an upward force may be manually applied to the elevator frame via the handle until the mattress is at its highest position as depicted at block 335 and 340. Once the highest position has been reached, releasing the pedal again will lock the gas strut in fully extended position as illustrated at block 345. Finally as illustrated at block 350, the child can be retrieved easily. Since the upward force may be applied from the outside of the crib, there is significantly less back strain associated with bending over the crib rail. This procedure is further facilitated by the fact that the strut is providing an assisting force upward.

Based on the foregoing, it can be appreciated that various embodiments can be implemented. For example, in one embodiment, a baby crib adjustment apparatus can be provided, which includes a crib frame for securing a fixed frame and an elevator frame, and a mattress capable of resting on the elevator frame. Additionally, a height adjusting mechanism can be provided for adjusting height of the elevator frame, in association with an operating mechanism for operating and locking the height adjusting mechanism, and a leveling mechanism for maintaining the level of the elevator frame horizontally stable.

In another embodiment, the lifting mechanism can be attached to the elevator frame for manually rising the elevator frame from outside when a child is on the mattress. In some embodiments, the mattress can be raised by exerting force on the operating mechanism and then locked at highest position by releasing the operating mechanism. Additionally, the mattress with a child can be easily raised by exerting forces on the operating mechanism and the lifting mechanism and then locked at highest position by releasing the operating mechanism. The mattress can also be lowered by exerting force on the operating mechanism and locked at lowest position by releasing the operating mechanism. In other embodiments, the height adjusting mechanism can adjust the height of the mattress by operating the operating mechanism and the lifting mechanism.

In still other embodiments, a baby crib adjustment apparatus can be configured which includes a fixed frame and an elevator frame, and a mattress resting on the elevator frame. The apparatus can include a height adjusting mechanism for adjusting height of the elevator frame, an operating mechanism for operating and locking the height adjusting mechanism, and a leveling mechanism for maintaining the level of the elevator frame horizontally stable. In other embodiments, the crib frame can be provided for securing the fixed frame and the elevator frame. In still other embodiments, a lifting mechanism can be attached to the elevator frame for manually rising the elevator frame from outside when a child is on the mattress.

The mattress can be raised by exerting force on the operating mechanism and then locked at highest position by releasing the operating mechanism. The mattress with the child can be effortlessly raised by exerting forces on the operating mechanism and the lifting mechanism and then locked at highest position by releasing the operating mechanism. The mattress can be lowered by exerting force on the operating mechanism and locked at lowest position by releasing the operating mechanism. The height adjusting mechanism can also adjust the height of the mattress by operating the operating mechanism and the lifting mechanism.

It should be noted that other alternative methods or devices or apparatus can be utilized for achieving the disclosed concept. For example a double set of scissors with a locking gas strut can be replaced by other arrangements utilizing, for example, a gas strut, hydraulic piston, or similar mechanism or component that can supply the force required to elevate or lower the mattress on demand.

It will be appreciated that variations of the above disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A baby crib adjustment apparatus, said apparatus comprising:

a crib frame for securing a fixed frame and an elevator frame connected by two sets of double scissors arranged to accept a locking gas strut therebetween;

a mattress resting on said elevator frame;

a height adjusting mechanism for adjusting height of said elevator frame;

an operating mechanism comprising a pedal for operating and locking said height adjusting mechanism, wherein said locking gas strut is releasable via said pedal and wherein said pedal causes said locking gas strut to release and exert sufficient force to raise said mattress or said elevator frame to a highest position; and a leveling mechanism comprising at least four guiding bars for maintaining a level of said elevator frame horizontally stable.

2. The apparatus of claim 1 further comprising a lifting mechanism attached to said elevator frame for manually rising said elevator frame from outside when a child is on said mattress.

3. The apparatus of claim 1 wherein said mattress is raised by exerting force on said operating mechanism and then locked at said highest position by releasing said operating mechanism.

4. The apparatus of claim 1 wherein said mattress with child is easily raised by exerting forces on said operating mechanism and said lifting mechanism and then locked at said highest position by releasing said operating mechanism.

5. The apparatus of claim 1 wherein said mattress is lowered by exerting force on said operating mechanism and locked at a lowest position by releasing said operating mechanism.

6. The apparatus of claim 1 wherein said height adjusting mechanism adjusts height of said mattress by operating said operating mechanism and said lifting mechanism.

7. A baby crib adjustment apparatus, said apparatus comprising:

a fixed frame and an elevator frame connected by two sets of double scissors arranged to accept a locking gas strut therebetween;

a mattress resting on said elevator frame;

a height adjusting mechanism for adjusting height of said elevator frame;

an operating mechanism comprising a pedal for operating and locking said height adjusting mechanism, wherein said locking gas strut is releasable via said pedal and wherein said pedal causes said locking gas strut to release and exert sufficient force to raise said mattress or said elevator frame to a highest position; and a leveling mechanism comprising four guiding bars for maintaining a level of said elevator frame horizontally stable.

8. The apparatus of claim 7 further comprising a crib frame for securing said fixed frame and said elevator frame.

9. The apparatus of claim 7 further comprising a lifting mechanism attached to said elevator frame for manually rising said elevator frame from outside when a child is on said mattress.

10. The apparatus of claim 7 wherein said mattress is raised by exerting force on said operating mechanism and then locked at highest position by releasing said operating mechanism.

11. The apparatus of claim 7 wherein said mattress with child is easily raised by exerting forces on said operating mechanism and said lifting mechanism and then locked at said highest position by releasing said operating mechanism.

12. The apparatus of claim 7 wherein said mattress is lowered by exerting force on said operating mechanism and locked at a lowest position by releasing said operating mechanism.

13. The apparatus of claim 7 wherein said height adjusting mechanism adjusts height of said mattress by operating said operating mechanism and said lifting mechanism.

14. A method of configuring a baby crib adjustment apparatus, said apparatus comprising:

providing a crib frame for securing a fixed frame and an elevator frame connected by two sets of double scissors arranged to accept a locking gas strut therebetween;

resting a mattress on said elevator frame;

providing a height adjusting mechanism for adjusting height of said elevator frame;

providing an operating mechanism comprising a pedal for operating and locking said height adjusting mechanism;

configuring said locking gas strut to be releasable via said pedal and configuring said pedal to cause said locking gas strut to release and exert sufficient force to raise said mattress or said elevator frame to a highest position; and providing a leveling mechanism comprising four guiding bars for maintaining a level of said elevator frame horizontally stable.

15. The method of claim 14 further comprising attaching a lifting mechanism to said elevator frame for manually rising said elevator frame from outside when a child is on said mattress.

16. The method of claim 14 wherein said mattress is raised by exerting force on said operating mechanism and then locked at said highest position by releasing said operating mechanism.

17. The method of claim 14 wherein said mattress with child is effortlessly raised by exerting forces on said operating mechanism and said lifting mechanism and then locked at said highest position by releasing said operating mechanism.

18. The method of claim 14 wherein said mattress is lowered by exerting force on said operating mechanism and locked at a lowest position by releasing said operating mechanism.

19. The method of claim 14 wherein said height adjusting mechanism adjusts height of said mattress by operating said operating mechanism and said lifting mechanism.

20. The method of claim 14 further comprising attaching a lifting mechanism to said elevator frame for manually rising said elevator frame from outside when a child is on said mattress, wherein said mattress is raised by exerting force on said operating mechanism and then locked at said highest position by releasing said operating mechanism.

* * * * *